US006562401B2

(12) United States Patent
Eaton

(10) Patent No.: US 6,562,401 B2
(45) Date of Patent: May 13, 2003

(54) METHOD FOR MAKING A STAND-OFF DEVICE TO PREVENT AN OILFIELD TUBULAR FROM CONTACTING THE SIDE OF THE WELLBORE

(75) Inventor: Benny Alan Eaton, Houston, TX (US)

(73) Assignee: Davis-Lynch, Inc., Houston, TX (US)

( * ) Notice: Subject to any disclaimer, the term of this patent is extended or adjusted under 35 U.S.C. 154(b) by 0 days.

(21) Appl. No.: 09/862,729

(22) Filed: May 23, 2001

(65) Prior Publication Data

US 2001/0032722 A1 Oct. 25, 2001

Related U.S. Application Data

(63) Continuation of application No. 09/245,799, filed on Feb. 5, 1999, now abandoned.

(51) Int. Cl.[7] ..... B05D 1/12

(52) U.S. Cl. ..... 427/195; 427/201; 427/386; 427/388.1

(58) Field of Search ..... 427/459, 486, 427/461, 185, 195, 201, 385.5, 386, 388.1; 166/173, 176, 241.2, 241.4, 247.6

(56) References Cited

U.S. PATENT DOCUMENTS

| | | | | |
|---|---|---|---|---|
| 3,981,359 | A | * | 9/1976 | Fortenberry |
| H1192 | H | * | 6/1993 | Keller |
| 6,015,015 | A | * | 1/2000 | Luft et al. |
| 6,123,987 | A | * | 9/2000 | Lescaut |

* cited by examiner

*Primary Examiner*—Fred J. Parker
(74) *Attorney, Agent, or Firm*—The Matthews Firm

(57) ABSTRACT

A stand-off device for tubulars comprising a sleeve adapted to fit around a tubular, the sleeve comprising an outer surface and a plurality of blades extending along the outer surface of the sleeve, the blades comprising a bearing surface, wherein the bearing surface of each blade is curved longitudinally. The device may be metallic or non-metallic. Non-metallic devices further comprise a protective coating to inhibit abrasion, corrosion, sparking, and electrolysis. The stand-off device is particularly suitable for use with casing in deviated wellbores.

19 Claims, 1 Drawing Sheet

METHOD FOR MAKING A STAND-OFF DEVICE TO PREVENT AN OILFIELD TUBULAR FROM CONTACTING THE SIDE OF THE WELLBORE

This application is a continuation of U.S. patent application Ser. No. 09/245,799 filed Feb. 5, 1999, now abandoned.

TECHNICAL FIELD

The present invention relates to stand-off devices to prevent an interior tubular, such as a pipe, casing, or other tubular or rod, from making contact with the sides of a wellbore or an exterior tubular to keep the interior tubular member from becoming stuck, hung up, or damaged. In addition, stand-off devices help facilitate an effective cement job, when cementing an interior tubular inside a well bore or exterior tubular.

BACKGROUND

In the completion of oil and gas wells, it is standard practice to set or cement at least one string of casing within the wellbore. Casing strings are cemented in the wellbore to prevent fluids from migrating from the production zone through the annulus between the casing string and the wellbore to the surface or other zones where for example fresh water may be contaminated. In addition, there are regulations which require that some zones be cemented off.

In cementing a casing string, a cement slurry is pumped down the interior of the casing string, out the lower end, into the annulus between the string and the wellbore. However, to effect an efficient cementing job, the complete annulus needs to be cemented without pockets in the cement and without areas in which the string is contacting the wall of the wellbore. To facilitate obtaining an effective cementing job the casing is commonly spaced away from the sides of the wellbore with a stand-off device that fits around the casing string. In addition, stand-off devices aide in running the pipe into the hole without hanging up.

Stand-off devices may also be used on tubular members in general, including casing or pipe strings, which are hung within another string of casing or pipe. These inner strings may or may not be cemented within the outer pipe string.

Stand-off devices are not limited in use to oil and gas wells. Stand-off devices may also find utility in any subterranean wells, such as disposal, injection, water, storage, and other types of wells, or any in any application where a tubular is disposed in another tubular or bore hole.

Stand-off devices for casing, tubing or pipe are commonly constructed of low grade carbon steel, and have a tubular body, cylindrical hole, shaft, or sleeve adapted to fit around a pipe joint. These prior art stand-off devices usually include outwardly bowed springs or strips having opposing ends connected to opposite ends of the sleeve. Although the resiliency of the bow strings or strips enables them to move through tight spots in the wellbore, they may not support the weight of the casing string, especially in a highly deviated wellbore.

In another type of prior art stand-off device, the bow strings or strips, which have a gap between the strip and the body of the stand-off device, are replaced by solid blades(no gap). The blades are tapered at each end to provide outer spaced bearing surfaces for engaging the wellbore or the outer casing. Although less prone to collapse than bow springs under the weight of the casing string, prior art blades are not shaped optimally to prevent the stand-off device from becoming stuck in the exterior casing or in the wellbore, as the case may be, upon encountering an obstruction or turn. This is particularly problematic in deviated wellbores, where gravity and other factors can cause the stand-off device to be disposed so off-center around the casing or in the wellbore, or where the standoff device is unable to negotiate around irregularities in the deviated wellbore due to a less than optimal shape of the blades. The stand-off device and the casing may become wedged in the well, and, in any case become unsuitable for providing a suitable cementing job.

Another reason stand-off devices become stuck is the presence of materials in the well that adhere to the stand-off device and inhibit its movement. Such materials include shale, gumbo, sand, and drilling mud.

One reason stand-off devices become stuck or hung up is because of their shape. Prior art blades comprise two portions: a tapered portion at each longitudinal end of each blade, which generally does not, and is not intended to contact the well bore or the outer tubular, and a bearing surface which does contact the inner surface of the bore or outer tubular. Further, prior art stand-off devices comprise a sleeve upon which the blades are disposed. The sleeve is substantially cylindrical, wherein the outer surface curves laterally in accordance with the circular cross section of a tube, but the outer surface does not curve longitudinally. Opposite sides of the sleeve are substantially parallel to each other, longitudinally. The bearing surface of all prior art blades is parallel, longitudinally, to the longitudinal axis of the device sleeve. That is, the bearing surface does not curve longitudinally. This lack of longitudinal curvature in the bearing surface of prior art blades is periodically referred to herein as flatness or being flat. The flatness of the bearing surface of prior art blades exacerbates the tendency of prior art devices to hang up or become stuck.

Prior art stand-off devices have further drawbacks when they are metal, especially when run and set within another string of pipe. One of the drawbacks is when the metal stand-off device is run into or when it vibrates due to slugs in production it contacts the outer pipe string and may cause a spark, which can be very hazardous in a hydrocarbon filled well. Also, metal stand-off devices create a corrosion problem with the casing strings which it contacts through electrolysis. Metal stand-off devices also are susceptible to damage when running acid and circulating the acid back out of the hole. Additionally, there is a concern with scrapping the inner diameter of stainless steel tubing when running stainless/duplex stainless steel tubing having metal stand-off devices and the machined inside diameters of drilling equipment that the stand-off device passes through such as blow out preventors.

It would be a benefit, therefore, to have a stand-off device adapted to fit about a string of pipe for centering the pipe in a wellbore or within an outer string of pipe, wherein the bearing surface of the blades is curved longitudinally to inhibit hang ups and to provide reliable movement of the stand-off device through the wellbore or outer string of pipe.

It would be a benefit to have a stand-off device that prevents materials such as shale, gumbo, sand, and drilling mud from adhering to it.

It would be a further benefit to have a stand-off device that has non-sparking properties.

It would be a still further benefit to have a stand-off device that provides cathodic protection between strings of casing to inhibit electrolysis.

It would be an additional benefit to have a stand-off device that is resistant to deterioration due to acid and caustic substances.

It would be a still further benefit to have a stand-off device that is easily installed either prior to or on location and that is lightweight while still having sufficient strength to withstand the forces encountered in casing operations.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DETAILED DESCRIPTION

The present device provides a sleeve that fits around tubulars, and blades extending from the sleeve that stand the tubular away from the sides of a wellbore or external tubular. Fluid may flow between the blades so that the present stand-off device does not form a substantial obstruction to fluid flow.

The blades have a bearing surface for bearing against a wellbore or an outer casing in which the casing carrying the stand-off device is disposed. The blades extend outwardly from the sleeve to space the carrying tubular string from the wellbore or outer casing string.

Figure 1:
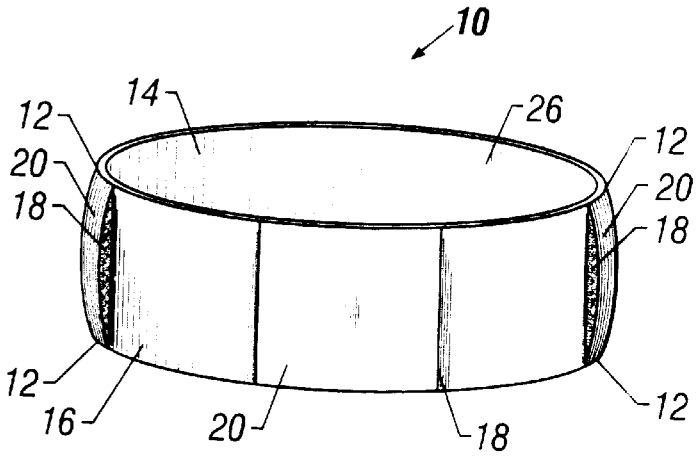
FIG. 1 is a perspective view of an embodiment of the stand-off device.

FIG. 1 is a perspective view of an embodiment of the stand-off device of the present invention generally designated by the numeral 10.

Referring to FIG. 1, stand-off device 10 comprises a sleeve 14 forming a bore 26 adapted to fit around a tubular, outer surface 16, and blades 18. Blades 18 have opposing longitudinal ends 12. Blades 18 further comprise bearing surface 20 for bearing against a wellbore or an outer casing in which the tubular that carries stand-off device 10 is disposed. In the preferred embodiment, bearing surface 20 is at least curved longitudinally, but may not be curved laterally. In one alternative embodiment, curvature greater than zero may be exhibited by substantially every portion of bearing surface 20. A flat surface has substantially zero curvature. Bearing surface 20 may be substantially devoid of a substantially flat portion. In another alternative embodiment, the curvature of bearing surface 20 may be substantially spherical.

Figure 2:
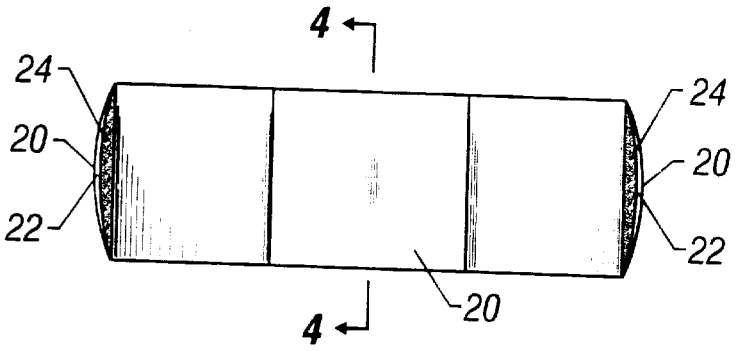
FIG. 2 is a side, partial cross-sectional view of an embodiment of the stand-off device, where the side blades are viewed in cross section.

Blades 18 and sleeve 14 may be of a unitary construction. As shown in FIG. 1, blades 18 extend substantially longitudinally along outer surface 16 and as shown are configured up and down, parallel to axis 4—4 of sleeve 14 (FIG. 2). However, blades 18 may extend longitudinally along outer surface 16 in a spiral or helical configuration, or any other desired configuration or combination of configurations.

FIG. 2 is a side view of an embodiment of the present stand-off device, showing blades 18 in cross section to reveal protective coating 22 over bearing surface 20 in one embodiment of the present stand-off device. Protective coating 22 is particularly useful for metal stand-off devices, such as those made of aluminum or steel, to prevent or inhibit corrosion, sticking or adhesion, abrasion, sparking, and electrical conduction (to inhibit electrolysis). Aluminum is the preferred metal for metallic stand-off devices. Nylon is the preferred material for protective coating 22. Ceramic is also a suitable coating material. Suitable protective coatings may further include, but are not limited to, plastic, phenolic, polyurethane, rubber, and TEFLON®. Composites or combinations of materials may also provide suitable protective coatings.

Figure 3:
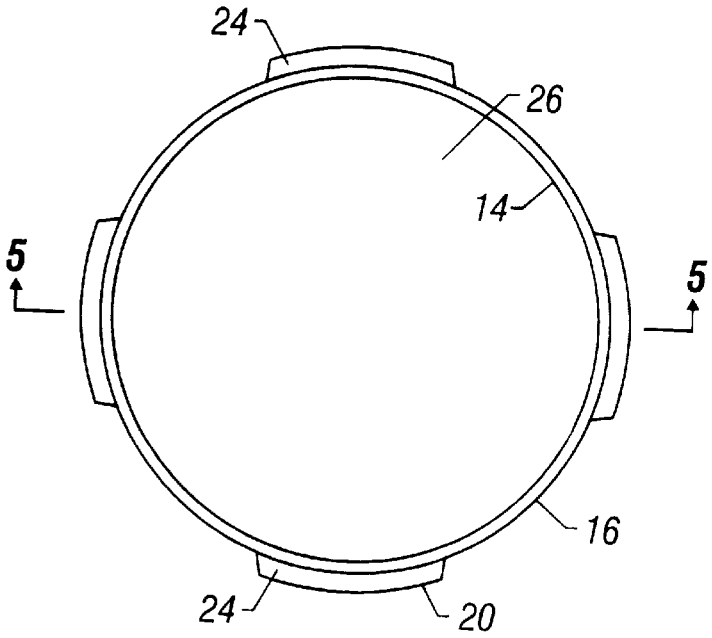
FIG. 3 is a top view of an embodiment of the standoff device.

FIG. 3 illustrates the lateral, side to side, curvature of blades 18, wherein bearing surface 20 comprises spherical curvature along line 5—5 identical to the longitudinal, up and down, curvature of blades 18 shown in FIGS. 1 and 2. Lateral blade sides 24 of blades 18 extend from bearing surface 20 to outer surface 16 of sleeve 14, and, in conjunction with outer surface 16 form a void or annulus between stand-off device 10 and the wellbore or outer tubular, when stand-off device 10 is disposed around a tubular in a wellbore or an outer tubular to allow the flow of fluid between stand-off device 10 and the wellbore or outer tubular. Blade sides 24 may be form in a variety of desired shapes, curves, or angles in relation to bearing surface 20 and outer surface 16. In the illustrative embodiment shown here, blade sides 24 are substantially perpendicular to outer surface 16. In other embodiments, sides 24 may be tapered, parabolically or hyperbolically curved, or otherwise slanted.

Bearing surface 20 of blades 18 may be longitudinally convex in relation to outer surface 16 of sleeve 14, and have opposing ends 12 curving inwardly toward the sleeve as they extend longitudinally down the sleeve.

In reference to FIGS. 2 and 3, now consider an embodiment where the curvature of bearing surface 20 may be substantially spherical. For a sphere, lateral curvature may be substantially the same as the longitudinal curvature as is the diagonal curvature. That is, the curvature is substantially the same up and down, sideways, and diagonally because the curvature of a sphere is the same at every point on the surface of the sphere.

Continuing with the substantially spherical embodiment, the curvature of bearing surface 20 may be determined by postulating a virtual sphere whose center may be determined by the intersection of longitudinal center line 4—4 in FIG. 2 and lateral center line 5—5 in FIG. 3. The radius of the virtual sphere is measured from the center of the sphere to bearing surface 20. The radius determines the size of the sphere, and thus the curvature of the sphere. The larger the radius, the larger the sphere and the flatter the curvature of the sphere. Conversely, the smaller the radius, the smaller the sphere, and the greater the curvature of the sphere. Generally, the radius of the virtual sphere, and thus the curvature of bearing surface 20, will be determined by the diameter of the wellbore or tubular around which stand-off device 10 will be disposed.

In the preferred embodiment, bearing surface 20 is curved at least longitudinally, along the axis described by line 4—4. With sufficient longitudinal curvature, the blades of device 10 lose the tapered ends of prior art stand-off device blades, such as is the case for the spherical embodiment described above. The longitudinal curvature of bearing surface 20 inhibits hangs ups in deviated bores or tubulars by providing more maneuverability to device 10, and by providing a shape more likely to overcome small obstructions in the path of the device.

The blades or bow springs of prior art stand-off devices are not curved longitudinally along their bearing surfaces. The bearing surfaces are flat. The ends of the prior art blades are tapered, so that they do not participate to any great extent, in the function of standing the tubular off from the inner surface of the bore. Longitudinally curving the bearing surface of the present device may substantially reduce or even eliminate the tapered ends of the blades.

One advantage of longitudinally curved blades, as found in the present device, is that the amount of contact surface area between the blades of the device and the interior surface of the outer bore or tubular is kept to a minimum, and is significantly less than the contact surface area of prior art devices. Reducing the amount of contact surface area is beneficial because the smaller the area of contact, the less likely become hangs ups. The flat blades of prior art devices present a substantial amount of surface area to the sides of the well bore or outer tubular, because the longitudinally flat surface is substantially parallel longitudinally to the surface of the bore or tubular it bears against. The prior art is like a flat surface on a flat surface, where substantially all of each surface is in contact with the other surface. The present device, however, comprises bearing surfaces which curve longitudinally away from the surface against which the blades bear. The blade makes essentially tangential contact with the interior sides of the bore or outer tubular. The present device is like a ball on a flat surface. The area contact is relatively small and tangential compared the prior art.

Another advantage of the present stand-off device is that the range of rotational or pivotal motion is enhanced. A result of the enhanced range of motion is that the present device is less likely to get stuck in a well bore or in an outer casing string, particularly where the well or outer casing is not vertical. In a deviated wellbore, such as found in slant, horizontal or other non-vertical drilling operations, stand-off devices tend to settle on their sides such that they are susceptible to becoming hung up by obstructions or irregularities in the wellbore. The present stand-off device, however, reduces the incidence of such hang ups because the shape naturally resists hang ups or wedging. The curved shape of the bearing surfaces of the present stand-off device allows the device to move substantially equally well in opposite directions, to reciprocate in the pipe, thereby enhancing the ability of the stand-off device to work itself out of hang ups. The non-flat shape of the bearing surfaces of the present device also enhances the ability of the device to crush pebbles or other small obstructions in the well bore or outer casing. Since the bearing surface is longitudinally curved, small obstructions are more likely to be rolled under the bearing surface and be crushed than would be case if an obstruction encountered a flat surface. Overcoming the presence of small obstructions further reduces the number of hangs ups.

The shape also allows the present stand-off device to move through curves in the wellbore or the casing more easily than if the bearing surfaces had flat portions. The present stand-off device allows for improved primary cement jobs when used in oil and gas field operations.

The blades of the present stand-off device may be formed in any desired configuration including, but not limited to, longitudinally up and down, slanted, helical, spiral, or other or some combination of configurations. In the preferred embodiment, stand-off device 10 is constructed of aluminum with a ceramic coating on bearing surface 20 and outer surface 16. Ceramic may be applied to surfaces 16, 20 of metal stand-off device 10 with the use of a suitable adhesive such as epoxy.

The present stand-off device may be made of any suitable material that is sufficiently strong and durable to withstand the forces, stresses, and environment found in an oil well. The environment may included the presence of corrosive agents, heat, salinity, acid, base, and high pressure. Among such suitable materials are nylon, plastic, phenolic, rubber, polyurethane, fiberglass, and composite materials.

These examples, among other materials, may be used in the construction and forming of stand-off device 10. It is preferred that stand-off device 10 be constructed of a material with characteristics capable of withstanding the forces and chemistry encountered in casing operations. Non-metallic embodiments of stand-off device 10 may comprise materials such as plastic, polyurethane, or composite materials, and may be manufactured by injection molding, catalyzed injection molding, machining, or other suitable methods.

The present stand-off device made be manufactured by a variety of suitable methods. For non-metal stand-off devices, such as plastic, polyurethane, or composites, processes such as injection molding may be suitable. Catalyzed injection molding or other molding processes may also be suitable. Metallic stand-off devices may be machined from a suitable metal, such as aluminum or steel, and then coated with a nylon coating, as described above. Metal stand-off devices may also be coated with ceramic by using an adhesive such as epoxy.

The present stand-off device may be made of metal, including steel. The preferred metal, however, is aluminum. A metallic embodiment of stand-off device 10 may be manufactured by machining the desired metal to achieve the spherical curvature of stand-off device 10. Alternatively, molten metal may be molded to form stand-off device 10.

Stand-off device 10, particularly metal embodiments, may have a coating on the outer surface to provide anti-corrosion, anti-stick, anti-abrasion, anti-sparking, and electrical insulation properties to the stand-off device. These properties are referred to generally herein as protective properties, and a coating providing such protection is referred to generally as a protective coating. Suitable protective coatings may include, but are not limited to, ceramic, plastic, phenolic, polyurethane, rubber, nylon, and TEFLON®. Composites or combinations of materials may also provide suitable protective coatings.

A metallic embodiment of stand-off device 10 may have coatings other than ceramic on surfaces 16, 20, such as nylon or plastic. A nylon coating may be achieved by exposing surface 16, 20 of stand-off device 10 to nylon powder, and melting the nylon powder such that the nylon melts and adheres to surface 16, 20 of stand-off device 10. A similar method may be used for plastic, composite or other suitable substances. In the preferred embodiment, the coating extends along the entire outer surface of stand-off device 10, including outer surface 16, bearing surface 20 and sides 22. Another embodiment may comprise a protective coating only on bearing surface 20.

To provide a metal stand-off device 10 comprising a ceramic coating, apply an initially fluid mixture of ceramic particles and epoxy to outer surface 16 of sleeve 14 and bearing surface 20 of blades 18; and cure the mixture to form a solid, whereby the solid adheres to surfaces 16, 20 of stand-off device 10 to provide a protective coating to stand-off device 10. As is well known, "ceramic" is a product manufactured by the action of heat on earthy raw materials, in which the element silicon with its oxide and complex compounds known as silicates occupy a predominate position. A wide range of ceramics is available as ultra-fine particles (10–150 microns).

Stand-off device 10 may be installed around casing on site, or may be installed remotely from a field site and transported to the site. Stand-off device 10 may be of unitary construction, or may be laterally or longitudinally split and fastened around casing by means of a suitable arrangement hinges, straps, pins and the like by methods known to those of ordinary skill in the art. Stand-off device 10 may be installed around casing and fastened to the casing with a suitable adhesive such as epoxy to maintain stand-off device 10 in a desired position on casing. In addition to adhesive, or alternatively thereto, stand-off device 10 may be held in a desired position on casing be means of a suitable stop.

The present stand-off device may be disposed around the casing by a variety of methods known to those of ordinary skill in the art. The stand-off device may be positioned on the pipe and allowed to float between the collars at adjacent casing joint connections. The stand-off device may be connected to the casing joint by an adhesive. The stand-off device may be split and attached by pins, or split and hinged and attached by pins or by a strap or belt around the sleeve. The stand-off device may be connected to the casing joint by set screws that are adjustably disposed through the stand-off device so as to engage the casing joint. The stand-off device may be fixedly connected to the casing joint via stop collars or rings connected to the casing string adjacent opposing ends of the stand-off device. Or some combination of the above methods may be used.

It can be seen from the preceding description that a stand-off device for tubulars, such as a string of pipe within a wellbore or another string of pipe, which is constructed to allow easier movement of the string of pipe through the wellbore or within an outer string of pipe, prevents materials from adhering to it, is non-sparking when contacting metal pipe strings, does not promote electrolysis when in contact with a pipe string and provides cathodic protection between strings of pipe, is resistant to acid, is easily installed, and is lightweight while still having sufficient strength to withstand the forces in casing operations has been provided.

It is noted that the embodiment of the stand-off device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not as limiting.

What is claimed is:

1. A method for making a metal stand-off device to prevent a tubular from contacting the side of a well bore or the side of an outer tubular, the method comprising:

manufacturing a sleeve adapted to fit around a tubular, the sleeve comprising an outer surface; and assembling blades to the outer surface of said sleeve to thereby extend along the outer surface of the sleeve, wherein each blade comprises a coated bearing surface, and wherein each bearing surface is curved longitudinally.

2. The method of claim 1, further comprising causing the bearing surface to be curved continuously orthogonally with respect to a longitudinal axis of the sleeve.

3. The method of claim 1, further comprising causing each blade to have a lateral length approximately the same as a longitudinal length thereof.

4. The method of claim 1, further comprising causing the total lateral length of the blades to cover up to approximately one half of the circumference of the sleeve.

5. The method of claim 4, wherein said blades comprise four blades.

6. The method of claim 5, further wherein said stand-off device comprises a metallic first material, and said bearing surface comprises a second non-metallic material different from the first material.

7. The method of claim 5, wherein said bearing surface is curved continuously longitudinally from one end of the blade to the other end of the blade.

8. The method of claim 1, further comprising exposing the bearing surface to nylon powder and melting the nylon powder.

9. The method of claim 1, further comprising applying an initially fluid mixture of ceramic particles and epoxy to the bearing surface and curing the mixture to form a solid.

10. A method for making a metal stand-off device to prevent a tubular from contacting the side of a well bore or the side of an outer tubular, the method comprising:

manufacturing a sleeve adapted to fit around a tubular, the sleeve comprising an outer surface;

assembling blades to the outer surface of said sleeve to thereby extend along the outer surface of the sleeve, wherein each blade comprises a bearing surface, and wherein each bearing surface is curved longitudinally;

exposing the outer surface of the sleeve and the bearing surface of the blades to nylon powder; and melting the nylon powder, whereby the melted nylon adheres to the metal outer surfaces of the stand-off device to provide a nylon coating to the stand-off device.

11. The method of claim 10, wherein each said blade has a lateral length approximately the same as a longitudinal length thereof.

12. The method of claim 10, wherein the total lateral length of the blades covers up to approximately one half of the circumference of the sleeve.

13. The method of claim 10, wherein the blades have a surface which varies longitudinally and laterally.

14. The method of claim 10, wherein the bearing surface is curved continuously orthogonally with respect to an axis of the sleeve.

15. A method for making a metal stand-off device to prevent a tubular from contacting the side of a well bore or the side of an outer tubular, the method comprising:

manufacturing a sleeve adapted to fit around a tubular, the sleeve comprising an outer surface;

assembling blades to the outer surface of said sleeve to thereby extend along the outer surface of the sleeve, wherein each blade comprises a bearing surface, and wherein each bearing surface is curved longitudinally;

applying an initially fluid mixture of ceramic particles and epoxy to the outer surface of the sleeve and the bearing surface of the blades; and curing the mixture to form a solid, whereby the solid adheres to the metal outer surfaces of the stand-off device to provide a ceramic coating to the stand-off device.

16. The method of claim 15, wherein each blade has a lateral length approximately the same as a longitudinal length thereof.

17. The method of claim 15, wherein the total lateral length of the blades covers up to approximately one half of the circumference of the sleeve.

18. The method of claim 15, wherein the blades have a surface which varies longitudinally and laterally.

19. The method of claim 15, wherein the bearing surface is curved continuously orthogonally with respect to a longitudinal axis of the sleeve.

* * * * *